US012480676B2

(12) United States Patent
Yang et al.

(10) Patent No.: US 12,480,676 B2
(45) Date of Patent: Nov. 25, 2025

(54) AIR CONDITIONER DEFROSTING METHOD

(71) Applicant: Guangdong Carrier HVAC Co., Ltd., Foshan (CN)

(72) Inventors: Yantu Yang, Guangdong (CN); Lijuan Zhou, Guangdong (CN)

(73) Assignee: GUANGDONG CARRIER HVAC CO., LTD., Foshan (CN)

( * ) Notice: Subject to any disclaimer, the term of this patent is extended or adjusted under 35 U.S.C. 154(b) by 222 days.

(21) Appl. No.: 18/187,020

(22) Filed: Mar. 21, 2023

(65) Prior Publication Data

US 2023/0296274 A1 Sep. 21, 2023

(30) Foreign Application Priority Data

Mar. 21, 2022 (CN) ..... 202210280997.5

(51) Int. Cl.
*F24F 11/42* (2018.01)

(52) U.S. Cl.
CPC ..... *F24F 11/42* (2018.01)

(58) Field of Classification Search
CPC . F24F 11/41; F24F 11/42; F25B 47/02; F25B 47/022; F25B 2347/00; F25B 2347/02; F25B 2347/023
See application file for complete search history.

(56) References Cited

U.S. PATENT DOCUMENTS 4,573,326 A * 3/1986 Sulfstede ..... F25D 21/006 62/128
2013/0180269 A1* 7/2013 Nagata ..... F25D 21/004 62/81
2016/0216026 A1* 7/2016 Denton ..... F24F 11/77
2020/0141602 A1* 5/2020 Ma ..... G05B 15/02
2020/0278146 A1* 9/2020 Mitsushima ..... F25B 47/025
2021/0080140 A1* 3/2021 Lee ..... F25B 13/00
(Continued)

FOREIGN PATENT DOCUMENTS

CN 107655150 A 2/2018
CN 107842970 A 3/2018
CN 108386960 A 8/2018
(Continued)

OTHER PUBLICATIONS

European Search Report for Application No. 23163234.0, Issued Jul. 28, 2023, 11 Pages.

*Primary Examiner* — Nelson J Nieves
(74) *Attorney, Agent, or Firm* — CANTOR COLBURN LLP

(57) ABSTRACT

An air conditioner defrosting method. In the air conditioner's heating process, after the end of every defrosting procedure, the temperature of the outdoor heat exchanger coil and the time used over the course of the defrosting procedure can be measured and recorded. The defrosting situation of the air conditioner is reflected, and an initial determination of whether there is frost accumulation is made. After the initial determination, the air conditioner continues carrying out the heating procedure, and when specific conditions are met, it carries out a third defrosting procedure. When second determination results indicate that there is frost accumulation, the frost accumulation problem is deemed to be quite severe with a risk of icing up, and it is necessary to conduct forced intervention and carry out forced defrosting steps.

8 Claims, 2 Drawing Sheets

(56) References Cited

U.S. PATENT DOCUMENTS

| | | | | |
|---|---|---|---|---|
| 2021/0254880 | A1* | 8/2021 | Yum | F25B 13/00 |
| 2023/0204276 | A1* | 6/2023 | Ito | F25B 49/02<br>62/140 |

FOREIGN PATENT DOCUMENTS

| | | | | | |
|---|---|---|---|---|---|
| CN | 106931694 | B | | 4/2019 | |
| CN | 111706957 | A | * | 9/2020 | F24F 11/38 |
| CN | 110762754 | B | | 12/2020 | |
| CN | 112524747 | A | | 3/2021 | |
| CN | 113154654 | A | * | 7/2021 | F24F 11/41 |
| CN | 113188237 | A | * | 7/2021 | F24F 11/42 |
| CN | 113959063 | A | * | 1/2022 | |

* cited by examiner

AIR CONDITIONER DEFROSTING METHOD

FOREIGN PRIORITY

This application claims priority to Chinese Patent Application No. 202210280997.5, filed Mar. 21, 2022, and all the benefits accruing therefrom under 35 U.S.C. § 119, the contents of which in its entirety are herein incorporated by reference.

TECHNICAL FIELD OF INVENTION

This invention relates to the technical field of cooling, and in particular, relates to an air conditioner defrosting method.

BACKGROUND OF THE INVENTION

In an air conditioner's heating process, many factors can influence the heating effects, and of these, incomplete defrosting of the outdoor heat exchanger can have a considerable influence on the heating effects, resulting in a bad user experience. When defrosting of the outdoor heat exchanger is incomplete, frost accumulates on the outdoor heat exchanger over a long period of time, ultimately causing the heat exchanger to ice up. After the outdoor heat exchanger ices up, it leads to a drop in heat exchange effects, and incomplete refrigerant evaporation causes liquid hammering of the compressor. In addition, if the outdoor heat exchanger ices up too thickly, it can cause damage to the fan blades from hitting the ice blocks.

Therefore, how to accurately understand the defrosting situation of an air conditioner, discover the problem of incomplete defrosting, and clear away the outdoor heat exchanger's accumulated frost in a timely manner, thereby avoiding having the outdoor heat exchanger ice up due to frost accumulation over a long period of time, is a problem in existing technology.

SUMMARY OF THE INVENTION

In order to be able to accurately understand the defrosting situation of an air conditioner, discover the problem of incomplete defrosting, and clear away the outdoor heat exchanger's accumulated frost in a timely manner, thereby avoiding having the outdoor heat exchanger ice up due to frost accumulation over a long period of time, this invention provides an air conditioner defrosting method, comprising the following steps: Defrosting Step S1: Carry out a first defrosting procedure, and measure and record the outdoor heat exchanger coil temperature after the first defrosting procedure T1 and/or the time used for the first defrosting procedure t1; Defrosting Step S2: Carry out a second defrosting procedure, and measure and record the outdoor heat exchanger coil temperature after the second defrosting procedure T2 and/or the time used for the second defrosting t2; Initial Determination Step S3: When first preset conditions are met, the initial determination is that there is frost accumulation; Defrosting Step S4: After it is initially determined that there is frost accumulation, carry out a third defrosting procedure, and measure and record the outdoor heat exchanger coil temperature after the third defrosting procedure T3 and/or the time used for the third defrosting t3; Second Determination Step S5: When second preset conditions are met, it is determined that there is frost accumulation; Forced Defrosting Step S6: After it is determined that there is frost accumulation, carry out a forced defrosting procedure.

According to the technical solutions provided by this invention, in the air conditioner heating process, after each defrosting procedure comes to an end, the temperature of the outdoor heat exchanger coil and the time used for the defrosting procedure are measured and recorded, thus reflecting the defrosting situation of the air conditioner, and an initial determination is made of whether there is frost accumulation, i.e., whether defrosting is complete and thorough. However, even if the initial determination results indicate that there is frost accumulation, forced intervention is not performed at this time, because mild frost accumulation is not enough to cause the outdoor heat exchanger to ice up and have a notable impact on heat exchange effects. This type of control method will not unnecessarily prolong defrosting times or add to the air conditioner's energy consumption, and it gives consideration to both defrosting effects and a user's experience. After Initial Determination Step S3, the air conditioner continues carrying out the heating procedure, and when specific conditions are met, it enters into Defrosting Step S4 and carries out the third defrosting procedure. When the second determination results indicate that there is frost accumulation, the frost accumulation problem is deemed to be rather severe with the risk of icing up, and it is necessary to perform forced intervention and carry out Forced Defrosting Step S6.

Here, the initial determination that there is frost accumulation in Initial Determination Step S3 and the determination that there is frost accumulation in Second Determination Step S5 both mean that there is a disparity between the air conditioner's actual defrosting situation and an ideal defrosting situation, i.e., compared to what is expected, the actual degree of frost accumulation is rather high.

It should be noted that Second Determination Step S5 and Forced Defrosting Step S6 have a precedence relationship in terms of logic, but temporally, they are performed practically at the same time. In other words, it is a relationship of rapid succession. Forced Defrosting Step S6 is carried out as soon as Defrosting Step S4 is completed and the second determination results indicate that there is frost accumulation. The purpose of Forced Defrosting Step S6 is to clear away accumulated frost from the outdoor heat exchanger coil with great thoroughness.

Here, as a preferred technical solution of this invention, after it is initially determined that there is frost accumulation in Initial Determination Step S3, the third defrosting procedure may be moderately adjusted in Defrosting Step S4, such as: appropriately raising the compressor's operating frequency in the third defrosting procedure, or appropriately adjusting the condition for exiting the third defrosting procedure, etc. That is, the interval of time between entering Defrosting Step S4 and entering Defrosting Step S2 may be less than the interval of time between entering Defrosting Step S2 and entering Defrosting Step S1.

In an advantageous technical solution of this invention, the first preset conditions are: the outdoor heat exchanger coil temperature after the second defrosting procedure T2 is less than the outdoor heat exchanger coil temperature after the first defrosting procedure T1, and/or the time used for the second defrosting procedure t2 is greater than or equal to the time used for the first defrosting procedure t1.

According to this preferred technical solution, the outdoor heat exchanger coil temperature after the second defrosting procedure T2 being less than the outdoor heat exchanger coil temperature after the first defrosting procedure T1 indicates that the temperature of the outdoor heat exchanger coil is falling as the air conditioner runs, and the degree of frost accumulation is exhibiting a growing trend. If this trend is allowed to continue developing, it will inevitably lead to the outdoor heat exchanger icing up. The time used for the second defrosting procedure t2 being greater than or equal to the time used for the first defrosting procedure t1 indicates that to remove accumulated frost from the outdoor heat exchanger coil becomes more time-consuming and more difficult. If this trend is allowed to continue developing, the time used for defrosting will get longer and longer, severely affecting the normal use of the air conditioner. Therefore, the first preset conditions reflect the air conditioner's defrosting situation, and the problem of incomplete defrosting can be discovered in a timely manner. At the same time, the parameters used in the determination are easily measured, and the algorithm used in the determination is simple and direct; this is beneficial to ensuring the stable operation of the air conditioner.

In an advantageous technical solution of this invention, the first preset conditions also include: the outdoor heat exchanger coil temperature after the second defrosting procedure T2 is less than 0° C.

According to this preferred technical solution, a rational determination regarding the frost accumulation trend of the outdoor heat exchanger can be made. If the condition of the outdoor heat exchanger coil temperature after the second defrosting procedure T2 being less than 0° C. is not met, the risk of the outdoor heat exchanger icing up is greatly reduced. In other words, at this time, the air conditioner's defrosting situation is normal and within a controllable range, and a preliminary judgment may be made that there is no incomplete defrosting problem.

In an advantageous technical solution of this invention, the second preset conditions are: the relationship among the outdoor heat exchanger coil temperature after the first defrosting procedure T1, the outdoor heat exchanger coil temperature after the second defrosting procedure T2, and the outdoor heat exchanger coil temperature after the third defrosting procedure T3 satisfies $T3<T2<T1$, and/or the relationship among the time used for the first defrosting procedure t1, the time used for the second defrosting procedure t2, and the time used for the third defrosting procedure t3 satisfies $t3 \geq t2 \geq t1$.

According to this preferred technical solution, a falling outdoor heat exchanger coil temperature and an increasing time used for the defrosting procedure are used as conditions for determining that there is frost accumulation and that it is necessary to perform the forced defrosting procedure. In this preferred technical solution, the second preset conditions match the first preset conditions; without introducing new judgment parameters, a second confirmation is made of the air conditioner's defrosting situation. This is beneficial to accurately understanding the actual defrosting situation, avoiding excessive defrosting that affects the normal heating procedure.

In an advantageous technical solution of this invention, the second preset conditions also include: the relationship among the outdoor heat exchanger coil temperature after the first defrosting procedure T1, the outdoor heat exchanger coil temperature after the second defrosting procedure T2, and the outdoor heat exchanger coil temperature after the third defrosting procedure T3 satisfies $|T2-T1|<|T3-T2|$.

According to this preferred technical solution, the change trend of the outdoor heat exchanger's degree of frost accumulation can be reflected, i.e., the outdoor heat exchanger's degree of frost accumulation is not just gradually rising, but also a quite steep change curve with a rapid rise. When this condition is met, it may be determined that the risk of the outdoor heat exchanger icing up is very high, and the forced defrosting step needs to be conducted. The second preset conditions in this preferred technical solution can reflect the acceleration of frost accumulation on the air conditioner and improve the determination accuracy of Second Determination Step S5.

In an advantageous technical solution of this invention, the first defrosting procedure, second defrosting procedure, and third defrosting procedure are general defrosting procedures.

According to this preferred technical solution, the first defrosting procedure, second defrosting procedure, and third defrosting procedure are general defrosting procedures; this means that the defrosting procedures carried out in Defrosting Step S1, Defrosting Step S2, and Defrosting Step S4 all are general defrosting procedures.

The first defrosting procedure, second defrosting procedure, and third defrosting procedure have the same entry conditions and the same exit conditions, and the operating parameters in the operating processes of the procedures, such as a compressor's operating frequency, are also the same. Such a control method simplifies the air conditioner's defrosting procedure during the heating process.

Here, the general defrosting procedure is relative to the forced defrosting procedure; that is, the general defrosting procedure and the forced defrosting procedure have different defrosting logics. A person skilled in the art may choose the specific control logic of the general defrosting procedure based on what is required.

In an advantageous technical solution of this invention, the general defrosting procedure is: running a compressor at a first frequency to conduct defrosting, and exiting the defrosting procedure after a first specified length of time.

According to this preferred technical solution, in the air conditioner's heating process, the time used for defrosting is limited, avoid having the defrosting time being too long that affects the normal heating procedure, and achieving a better user experience.

In an advantageous technical solution of this invention, the forced defrosting procedure is: running a compressor at a second frequency to conduct defrosting, until the condition for exiting forced defrosting is met, wherein the second frequency is greater than the first frequency.

According to this preferred technical solution, compared with the general defrosting procedure, the compressor's operating frequency is increased in the forced defrosting procedure, accelerating the defrosting speed. Also, a condition for exiting forced defrosting is set, ensuring that after the forced defrosting procedure, the accumulated frost can be cleared away from the outdoor heat exchanger.

In an advantageous technical solution of this invention, the condition for exiting forced defrosting is: the outdoor heat exchanger coil temperature T4 in the forced defrosting procedure is greater than or equal to a specified temperature, and it is kept greater than or equal to the specified temperature for a second specified length of time.

According to this preferred technical solution, it can be ensured that the temperature of the outdoor heat exchanger coil stays at a relatively high temperature for a period of time, achieving the goal of clearing away accumulated frost from the outdoor heat exchanger.

In an advantageous technical solution of this invention, the outdoor heat exchanger coil temperature is measured using a temperature measuring device located at the bottom of the outdoor heat exchanger.

According to this preferred technical solution, the bottom of the outdoor heat exchanger is the most likely location for frost accumulation, and by setting the temperature measuring device at the outdoor heat exchanger's most likely location for frost accumulation, it can be ensured that the most likely location for frost accumulation will not ice up due to incomplete defrosting, thereby avoiding blind spots in defrosting.

Here, as a preferred technical solution of this invention, the temperature measuring device is located on the outdoor heat exchanger, far away from the fan. This is because the inventors discovered that the location on the bottom of the outdoor heat exchanger far away from the fan is often the location where frost accumulation is most likely and is a defrosting blind spot.

DETAILED DESCRIPTION OF THE INVENTION

Below, the attached drawings are referenced to describe preferred embodiments of this invention. Persons skilled in the art should understand that these embodiments are used merely to explain the technical principles of this invention, and they are not intended to limit the scope of protection of this invention. Persons skilled in the art may make adjustments as needed to adapt to specific application scenarios. In addition, it should also be noted that, for ease of description, the attached drawings only show the parts associated with the invention.

It should be noted that where there is no conflict, this application's embodiments and the features therein may be interchangeably combined. Referencing the attached drawings in combination with the embodiments, a detailed description of this application is given below.

Embodiment 1

In order to be able to accurately understand the air conditioner's defrosting situation, discover incomplete defrosting problems, and clear away the outdoor heat exchanger's accumulated frost in a timely manner, thereby avoiding having the outdoor heat exchanger ice up due to frost accumulation over a long period of time, this embodiment provides an air conditioner defrosting method, comprising the following steps: Defrosting Step S1: Carry out a first defrosting procedure, and measure and record the outdoor heat exchanger coil temperature after the first defrosting procedure T1 and/or the time used for the first defrosting t1; Defrosting Step S2: Carry out a second defrosting procedure, and measure and record the outdoor heat exchanger coil temperature after the second defrosting procedure T2 and/or the time used for the second defrosting t2; Initial Determination Step S3: When first preset conditions are met, the initial determination is that there is frost accumulation; Defrosting Step S4: After it is initially determined that there is frost accumulation, carry out a third defrosting procedure, and measure and record the outdoor heat exchanger coil temperature after the third defrosting procedure T3 and/or the time used for the third defrosting t3; Second Determination Step S5: When second preset conditions are met, it is determined that there is frost accumulation; Forced Defrosting Step S6: After it is determined that there is frost accumulation, carry out a forced defrosting procedure.

Figure 1:
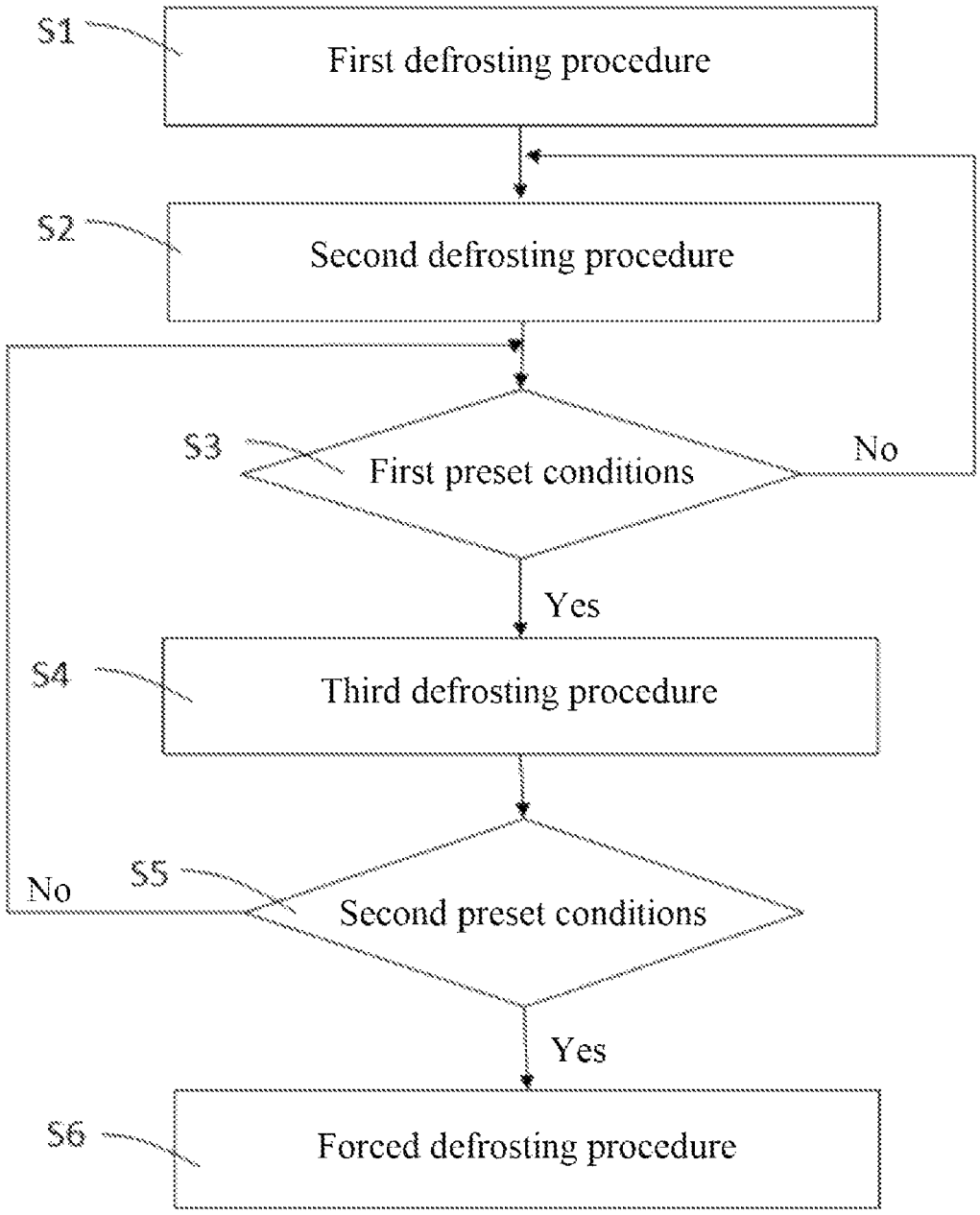
FIG. 1 is a flow chart of the air conditioner defrosting method provided in the first embodiment of this invention.

Referring to FIG. 1, based on the air conditioner defrosting method provided in this embodiment, because there is Forced Defrosting Step S6, it is possible to discover incomplete defrosting problems and clear away the outdoor heat exchanger's accumulated frost in a timely manner, thereby avoiding having the outdoor heat exchanger ice up due to frost accumulation over a long period of time. Because there are Initial Determination Step S3 and Second Determination Step S5 before Force Defrosting Step S6, it is possible to prevent excessive defrosting (a discrepancy between the ascertained frost accumulation situation and the actual frost accumulation situation), avoiding unnecessarily sacrificing user experience or increasing energy consumption.

Specifically, the air conditioner defrosting method provided by this embodiment is carried out during the air conditioner's heating process. The air conditioner's entire control flow is as follows: heating procedure→Defrosting Step S1→heating procedure→Defrosting Step S2→Initial Determination Step S3→heating procedure→Defrosting Step S4→Second Determination Step S5→Forced Defrosting Step S6→heating procedure.

Preferably, the first defrosting procedure, second defrosting procedure, and third defrosting procedure are general defrosting procedures, the three have the same entry conditions and the same exit conditions, and the operating parameters in the operating processes of the procedures, such as the compressor's operating frequency, are also the same. Such a control method simplifies the air conditioner's defrosting procedure during the heating operation process.

In other embodiments, the first defrosting procedure, second defrosting procedure, and third defrosting procedure may have different entry conditions, exit conditions, and operating parameters. For example, after it is initially determined that there is frost accumulation, the time interval between the second defrosting procedure and the third defrosting procedure may be shortened, or the compressor's operating frequency in the third defrosting procedure may be appropriately raised.

The general defrosting procedure is: running a compressor at a first frequency to conduct defrosting, and exiting the defrosting procedure after a first specified length of time.

In other embodiments, the exit condition of the general defrosting procedure is not only a time length limit. For example, the exit condition of the general defrosting procedure may be allowing a specific length of time to pass (3 minutes) after the outdoor heat exchanger coil temperature is greater than a specific temperature (greater than 0° C.).

It can be understood that the setting of first preset conditions in Initial Determination Step S3 and the setting of second preset conditions in Second Determination Step S5 are associated with the exit conditions of the general defrosting procedure. In this embodiment, the exit condition of the general defrosting procedure is to exit the general defrosting procedure after a first specified length of time is reached. Thus, the time used for defrosting after each general defrosting procedure comes to an end is the same, and the time used for defrosting cannot reflect the outdoor heat exchanger's frost accumulation situation. At such a time, the outdoor heat exchanger's frost accumulation situation can only be reflected by changes in the temperature of the outdoor heat exchanger coil. By the same token, in other embodiments, when the exit conditions of the general defrosting procedure only relate to the temperature of the outdoor heat exchanger coil, only the time used for defrosting can reflect the outdoor heat exchanger's frost accumulation situation. When the exit conditions of the general defrosting procedure relate both to the temperature of the outdoor heat exchanger coil and to the time used for defrosting, both the temperature of the outdoor heat exchanger coil and the time used for defrosting can reflect the outdoor heat exchanger's frost accumulation situation. Here, the temperature of the outdoor heat exchanger coil is an index that more directly reflects the outdoor heat exchanger's frost accumulation situation, whereas the time used for defrosting is an index that indirectly reflects the outdoor heat exchanger's frost accumulation situation.

In summary, in order to avoid influencing the heating effects of a normal heating process due to a defrosting time that is too long, the general defrosting procedure often has a time limit.

Preferably, the forced defrosting procedure is: running the compressor at a second frequency (higher than the first frequency in the general defrosting procedure) to conduct defrosting until the outdoor heat exchanger coil temperature in the forced defrosting procedure T4 is greater than or equal to a specified temperature, and it is kept greater than or equal to a specified temperature for second specified length of time. In other words, the forced defrosting procedure raises the compressor's operating frequency and accelerates the defrosting speed, and the forced defrosting procedure does not have a time limit, with the purpose of clearing away accumulated frost from the outdoor heat exchanger.

Specifically, the air conditioner gauges the outdoor heat exchanger coil temperature and the time used for the defrosting procedure after each defrosting to determine whether the state of the outdoor heat exchanger after defrosting is worse than its state after the previous defrosting, thereby ascertaining whether defrosting is complete. When the determination result after Initial Determination Step S3 and Second Determination Step S5 is that defrosting is incomplete, the forced defrosting procedure may be carried out immediately. The general defrosting procedure has a time limit, and the forced defrosting procedure has no time limit; it is only exited after defrosting is complete, and the normal heating procedure is restarted. This control method ensures the heating effects of the normal heating process and avoids the problems of the outdoor heat exchanger icing up or damage to the compressor due to incomplete defrosting.

Preferably, the temperature of the outdoor heat exchanger coil is measured by a temperature probe located at the bottom of the outdoor heat exchanger, because the bottom of the outdoor heat exchanger is the most likely location for frost accumulation. There are two reasons causing to this situation: one is the result of nonuniform wind speeds acting on the various locations of the outdoor heat exchanger; the bottom has the lowest wind speed, poor heat exchange effects, and the lowest surface temperature, and it is the most likely location for frost accumulation; the second is because the defrost water of the outdoor heat exchanger can condense and ice up at the bottom of the outdoor heat exchanger.

By placing the temperature probe on the flow path where frost accumulation is most likely on the outdoor heat exchanger, it can be ensured that the most likely location for frost accumulation will not ice up due to incomplete defrosting, avoiding blind spots in defrosting.

Embodiment 2

Figure 2:
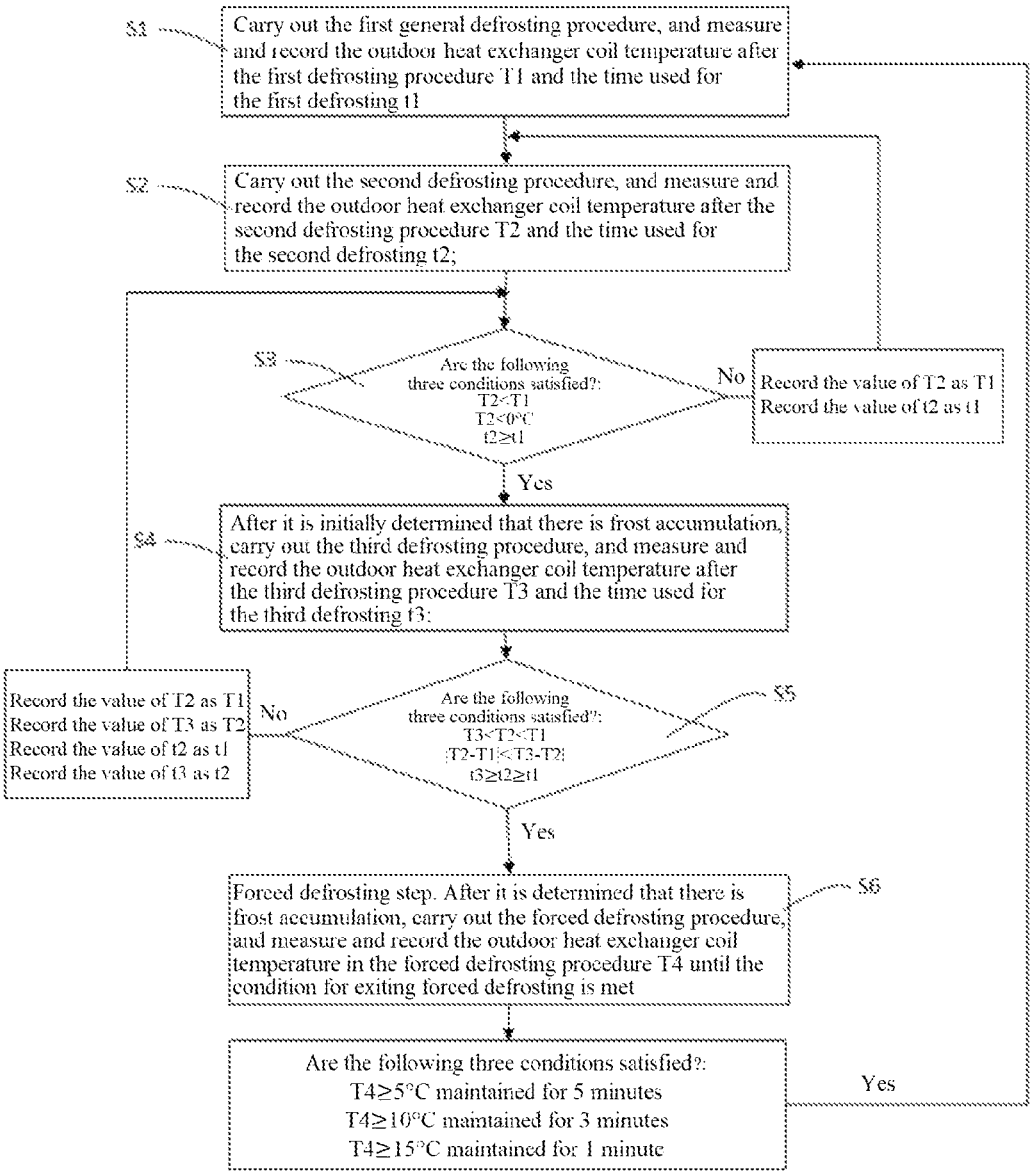
FIG. 2 is a flow chart of the air conditioner defrosting method provided in the second embodiment of this invention.

Next is a description of the air conditioner defrosting method of Embodiment 2 in combination with FIG. 2.

Defrosting Step S1: Carry out a first general defrosting procedure, and measure and record the outdoor heat exchanger coil temperature after the first defrosting procedure T1 and the time used for the first defrosting t1.

Defrosting Step S2: Carry out a second defrosting procedure, and measure and record the outdoor heat exchanger coil temperature after the second defrosting procedure T2 and the time used for the second defrosting t2.

Initial Determination Step S3: When the conditions of $T2<T1$, $T2<0°$ C., and $t2\geq t1$ are met, the initial determination is that there is frost accumulation; when the conditions of $T2<T1$, $T2<0°$ C., and $t2\geq t1$ are not met, after recording the value of T2 as T1 and recording the value of t2 as t1, carry out Defrosting Step S2.

The outdoor heat exchanger coil temperature after the second defrosting procedure T2 being less than the outdoor heat exchanger coil temperature after the first defrosting procedure T1 indicates that the temperature of the outdoor heat exchanger coil is falling as the air conditioner runs, and the degree of frost accumulation is exhibiting a growing trend. If this trend is allowed to continue developing, it will inevitably lead to the outdoor heat exchanger icing up. The outdoor heat exchanger coil temperature after the second defrosting procedure T2 being less than 0° C. indicates that the outdoor heat exchanger is at risk of icing up. If the condition of the outdoor heat exchanger coil temperature after the second defrosting procedure T2 being less than 0° C. is not met, the risk of the outdoor heat exchanger icing up is greatly reduced. In other words, at this time, the air conditioner's defrosting situation is normal and within a controllable range, and a preliminary judgment may be made that there is no frost accumulation problem. The time used for the second defrosting procedure t2 being greater than or equal to the time used for the first defrosting procedure t1 indicates that to remove accumulated frost from the outdoor heat exchanger coil becomes more time-consuming and more difficult. If this trend is allowed to continue developing, the time used for defrosting will get longer and longer, severely affecting the normal use of the air conditioner. Therefore, the first preset conditions reflect the air conditioner's defrosting situation, and the problem of incomplete defrosting can be discovered in a timely manner.

General Defrosting Step S4: After it is initially determined that there is frost accumulation, carry out a third defrosting procedure, and measure and record the outdoor heat exchanger coil temperature after the third defrosting procedure T3 and the time used for the third defrosting procedure t3.

Second Determination Step S5: When the conditions of $T3<T2<T1$, $|T2-T1|<|T3-T2|$ and $t3\geq t2\geq t1$ are met, it is determined that there is frost accumulation; when the conditions of $T3<T2<T1$, $|T2-T1|<|T3-T2|$, and $t3\geq t2\geq t1$ are not met, record the value of T2 as T1, record the value of T3 as T2, record the value of t2 as t1, record the value of t3 as t2, and carry out Initial Determination Step S3.

The condition of $T3<T2<T1$ indicates that the outdoor heat exchanger coil temperature is falling, and the condition of $t3\geq t2\geq t1$ indicates that the time used for the defrosting procedure is getting longer. Using these as the conditions for determining that there is frost accumulation and that it is necessary to perform the forced defrosting procedure achieves matching with the first preset conditions, and without needing to introduce new judgment parameters, a second confirmation is made of the air conditioner's defrosting situation. In addition, the condition of $|T2-T1|<|T3-T2|$ reflects the change trend of the outdoor heat exchanger's degree of frost accumulation, i.e., the outdoor heat exchanger's degree of frost accumulation is not just gradually rising, but also a quite steep change curve with a rapid rise. When this condition is satisfied, it can be determined that there is very high risk of the outdoor heat exchanger icing up, and that it is necessary to conduct the forced defrosting steps.

Forced Defrosting Step S6: After it is determined that there is frost accumulation, carry out a forced defrosting procedure, and measure and record the outdoor heat exchanger coil temperature in the forced defrosting procedure T4 until the condition for exiting forced defrosting is met.

As an example, the condition for exiting forced defrosting may be: T4≥5° C. maintained for 5 minutes or T4≥10° C. maintained for 3 minutes or T4≥15° C. maintained for 1 minute.

The air conditioner defrosting methods of FIGS. 1 and 2 may be implemented using a controller of an air conditioning system. The controller of the air conditioning system may be implemented using a general-purpose microprocessor executing a computer program stored on a storage medium to perform the operations described herein. Alternatively, the controller may be implemented in hardware (e.g., ASIC, FPGA) or in a combination of hardware/software.

The preceding description is merely preferred embodiments of this application and an explanation of the technical principles employed. A person skilled in the art should understand that the scope of the invention involved in this application is not limited to technical solutions formed from specific combinations of the technical features discussed above, and that it should also cover other technical solutions formed from any combinations of the technical features discussed above or their equivalent features, given that they do not deviate from the inventive concepts. An example would be a technical solution formed by interchanging the features discussed above with technical features possessing similar functions with those disclosed in this application (but not limited thereto).

What is claimed is:

1. An air conditioner defrosting method comprising:

Defrosting Step S1: Carry out a first defrosting procedure, and measure and record an outdoor heat exchanger coil temperature T1 after the first defrosting procedure and/or a time t1 used for the first defrosting procedure;

Defrosting Step S2: Carry out a second defrosting procedure, and measure and record an outdoor heat exchanger coil temperature T2 after the second defrosting procedure and/or a time t2 used for the second defrosting procedure;

Initial Determination Step S3: determining that there is frost accumulation in response to a first preset condition being met;

Defrosting Step S4: carry out a third defrosting procedure, and measure and record an outdoor heat exchanger coil temperature T3 after a third defrosting procedure and/or a time used for the third defrosting procedure t3;

Second Determination Step S5: determining that there is frost accumulation in response to a second preset condition being met;

Forced Defrosting Step S6: carry out a forced defrosting procedure;

wherein the first defrosting procedure, the second defrosting procedure, and the third defrosting procedure each includes running a compressor at a first frequency to conduct defrosting, and exiting the defrosting procedure after a first specified length of time;

wherein the forced defrosting procedure includes running the compressor at a second frequency to conduct defrosting until a condition for exiting forced defrosting is met, wherein the second frequency is greater than the first frequency;

wherein a condition for exiting the forced defrosting comprises an outdoor heat exchanger coil temperature T4 in the forced defrosting procedure is greater than or equal to a specified temperature, and the outdoor heat exchanger coil temperature T4 greater than or equal to the specified temperature for a second specified length of time.

2. The air conditioner defrosting method according to claim 1, wherein the first preset condition includes: the outdoor heat exchanger coil temperature after the second defrosting procedure T2 is less than the outdoor heat exchanger coil temperature after the first defrosting procedure T1, and/or the time used for the second defrosting procedure t2 is greater than or equal to the time used for the first defrosting procedure t1.

3. The air conditioner defrosting method according to claim 2, wherein the first preset condition includes: the outdoor heat exchanger coil temperature after the second defrosting procedure T2 is less than 0° C.

4. The air conditioner defrosting method according to claim 1, wherein the second preset condition includes a relationship among the outdoor heat exchanger coil temperature after the first defrosting procedure T1, the outdoor heat exchanger coil temperature after the second defrosting procedure T2, and the outdoor heat exchanger coil temperature after the third defrosting procedure T3 satisfies T3<T2<T1, and/or the relationship among the time used for the first defrosting procedure t1, the time used for the second defrosting procedure t2, and the time used for the third defrosting procedure t3 satisfies t3≥t2≥t1.

5. The air conditioner defrosting method according to claim 4, wherein the second preset condition includes:

a relationship among the outdoor heat exchanger coil temperature after the first defrosting procedure T1, the outdoor heat exchanger coil temperature after the second defrosting procedure T2, and the outdoor heat exchanger coil temperature after the third defrosting procedure T3 satisfies |T2−T1|</T3−T2|.

6. The air conditioner defrosting method according to claim 2, wherein the outdoor heat exchanger coil temperature after the first defrosting procedure T1, the outdoor heat exchanger coil temperature after the second defrosting procedure T2, the outdoor heat exchanger coil temperature after the third defrosting procedure T3, and the outdoor heat exchanger coil temperature in the forced defrosting procedure T4 are measured using a temperature measuring device located at a bottom of the outdoor heat exchanger.

7. An air conditioner defrosting method comprising:

Defrosting Step S1: Carry out a first defrosting procedure, and measure and record an outdoor heat exchanger coil temperature T1 after a first defrosting procedure;

Defrosting Step S2: Carry out a second defrosting procedure, and measure and record an outdoor heat exchanger coil temperature T2 after the second defrosting procedure;

Initial Determination Step S3: determining that there is frost accumulation in response to a first preset condition being met;

Defrosting Step S4: carry out a third defrosting procedure, and measure and record the outdoor heat exchanger coil temperature after a third defrosting procedure T3;

Second Determination Step S5: determining that there is frost accumulation in response to a second preset condition being met;

Forced Defrosting Step S6: carry out a forced defrosting procedure;

characterized in that the first preset conditions are: the outdoor heat exchanger coil temperature after the second defrosting procedure T2 is less than the outdoor heat exchanger coil temperature after the first defrosting procedure T1;

a relationship among the outdoor heat exchanger coil temperature after the first defrosting procedure T1, the outdoor heat exchanger coil temperature after the second defrosting procedure T2, and the outdoor heat exchanger coil temperature after the third defrosting procedure T3 satisfies $T3<T2<T1$.

8. An air conditioner defrosting method comprising:

Defrosting Step S1: Carry out a first defrosting procedure, and measure and record a time t1 used for the first defrosting procedure;

Defrosting Step S2: Carry out a second defrosting procedure, and measure and record a time t2 used for the second defrosting procedure;

Initial Determination Step S3: determining that there is frost accumulation in response to a first preset condition being met;

Defrosting Step S4: carry out a third defrosting procedure, and measure and record a time used for the third defrosting procedure t3;

Second Determination Step S5: determining that there is frost accumulation in response to a second preset condition being met;

Forced Defrosting Step S6: carry out a forced defrosting procedure;

wherein the first preset conditions includes the time used for the second defrosting procedure t2 is greater than or equal to the time used for the first defrosting procedure t1;

wherein the second preset conditions includes a relationship among the time used for the first defrosting procedure t1, the time used for the second defrosting procedure t2, and the time used for the third defrosting procedure t3 satisfies $t3 \geq t2 \geq t1$.

* * * * *